US005534840A

United States Patent [19]

Cuingnet

[11] Patent Number: 5,534,840

[45] Date of Patent: Jul. 9, 1996

[54] CONTROL AND/OR INDICATOR UNIT

[75] Inventor: Patrick Cuingnet, Soyaux, France

[73] Assignee: Schneider Electric SA, Boulogne Billancourt, France

[21] Appl. No.: 270,666

[22] Filed: Jul. 5, 1994

[30] Foreign Application Priority Data

Jul. 2, 1993 [FR] France ..... 93 08234

[51] Int. Cl.[6] ..... H01H 37/00; H01H 9/00

[52] U.S. Cl. ..... 337/1; 200/314; 200/317

[58] Field of Search ..... 337/206, 1; 200/310, 200/314, 315, 316, 317

[56] References Cited

U.S. PATENT DOCUMENTS

| | | | |
|---|---|---|---|
| 2,780,801 | 2/1957 | Tyler | 200/314 |
| 3,246,110 | 4/1966 | Hermanson | 200/167 |
| 3,286,061 | 11/1966 | Henderson . | |
| 3,511,955 | 5/1970 | Frank | 200/167 |
| 3,983,348 | 9/1976 | Kellogg | 200/314 |
| 4,350,857 | 9/1982 | Fillus | 200/314 |
| 4,394,546 | 7/1983 | Harumatsu | 200/314 |
| 4,549,050 | 10/1985 | Lang | 200/314 |

FOREIGN PATENT DOCUMENTS

| | | | |
|---|---|---|---|
| 8332474 | 2/1984 | Germany . | |
| 952913 | 3/1964 | United Kingdom | 200/314 |
| 2205390 | 12/1988 | United Kingdom . | |
| 2261551 | 5/1993 | United Kingdom . | |

*Primary Examiner*—Leo P. Picard
*Assistant Examiner*—Stephen T. Ryan
*Attorney, Agent, or Firm*—Oblon, Spivak, McClelland, Maier & Neustadt

[57] ABSTRACT

A control and/or indicator unit with screw terminals includes a one-piece body forming a flange provided with an external screwthread for fitting it by means of a nut to a support and surrounded at the rear by a cap in which are openings for wires and for access to the screws whose axes are parallel to the axis of symmetry of the body. The screws cooperate with connecting areas of bent conductive members held eccentric to the axis of symmetry in the body which provides a cylindrical internal housing open on the same side as the conductive members for at least one mobile contact plunger or a mobile contact plunger and a luminous component or a luminous component.

12 Claims, 7 Drawing Sheets

CONTROL AND/OR INDICATOR UNIT

BACKGROUND OF THE INVENTION

1. Field of the Invention

The present invention concerns a control and/or indicator unit with screw terminals for use in systems controlling and monitoring electrical or electronic installations or equipment.

2. Description of the Prior Art

To switch circuits on and off and to indicate the voltage status, correct operation and faults, such installations require control and/or indicator units: pushbutton switches, pushbutton switches with integral indicator lamp, indicator lamps.

Patent EP-A-0 342 703 describes control or control and indicator units comprising a head and a block containing either the contacts or the luminous component, the two parts being separable or joined together. This design lends itself to a great variety of products.

Patent FR-A-2 616 265 describes one-piece pushbutton switches and patent FR-A-2 616 207 describes one-piece indicator lamps. The one-piece design enables direct fitting from the front to a panel or a wall. The screws connecting the conductors are not protected, however.

Document DE-A-83 32 474.7 describes a control or indicator unit including a cap protecting two screw terminals. Each terminal comprises a connection block in which is an opening through which the wire is passed. A screwthreaded hole opens into this opening and receives a clamping screw whose end clamps the wire, this end being in contact with the wire. The connection possibilities are limited by the diameter of the opening. Each terminal is screwed to a transverse partition with no space for a mobile plunger or for lamp power supply members attached to the terminals.

An object of the present invention is to provide monolithic or one-piece control and/or indicator units with protected screws. The arrangement of these units has advantages from the cost point of view and fitting and wiring are simple. A specific object of the invention is to provide switches with double-break contacts.

SUMMARY OF THE INVENTION

The control and/or indicator unit with screw terminals of the invention includes a one-piece body forming a flange provided with an external screwthread for fitting it by means of a nut to a support and surrounded at the rear by a cap in which are openings for wires and for access to the screws whose axes are parallel to the axis of symmetry of the body, in which unit the screws cooperate with connecting areas of bent conductive members held eccentric to the axis of symmetry in the body which provides a cylindrical internal housing open on the same side as the conductive members for at least one mobile contact plunger or a mobile contact plunger and a luminous component or a luminous component.

According to one feature of the invention the unit body guides translation in same housing of a hollow cylindrical mobile plunger having at least one lateral projection forming a cage in which is mounted a contact bridge cooperating with contacts fixed to the conductive members.

According to one feature of the invention the unit comprises four conductive members provided with fixed contacts and the plunger includes two lateral extensions forming cages for two contact bridges.

According to one feature of the invention the unit comprises two conductive members provided with fixed contacts and two conductive members for supplying power to a luminous component.

According to one feature of the invention the unit comprises a cap surrounding the rear of the body with openings in the side for conductors to be connected to the terminals and openings at the rear for access of a tool for operating the screws, The invention will now be described in more detail with reference to embodiments shown by way of example in the appended drawings,

DETAILED DESCRIPTION OF THE PREFERRED EMBODIMENTS

Figure 2:
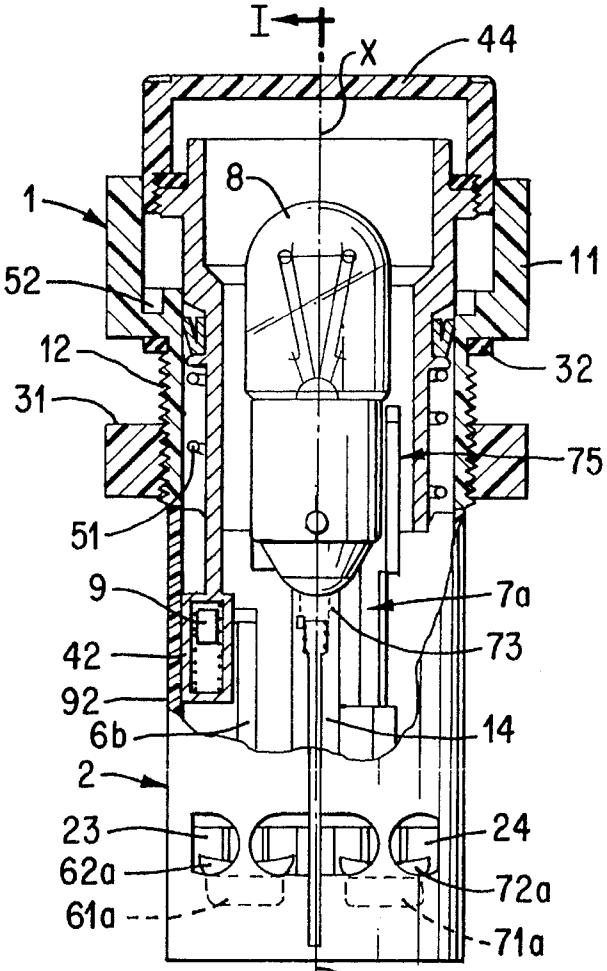
FIG. 2 is a view in axial section on the line II—II in FIG. 1.
Figure 1:
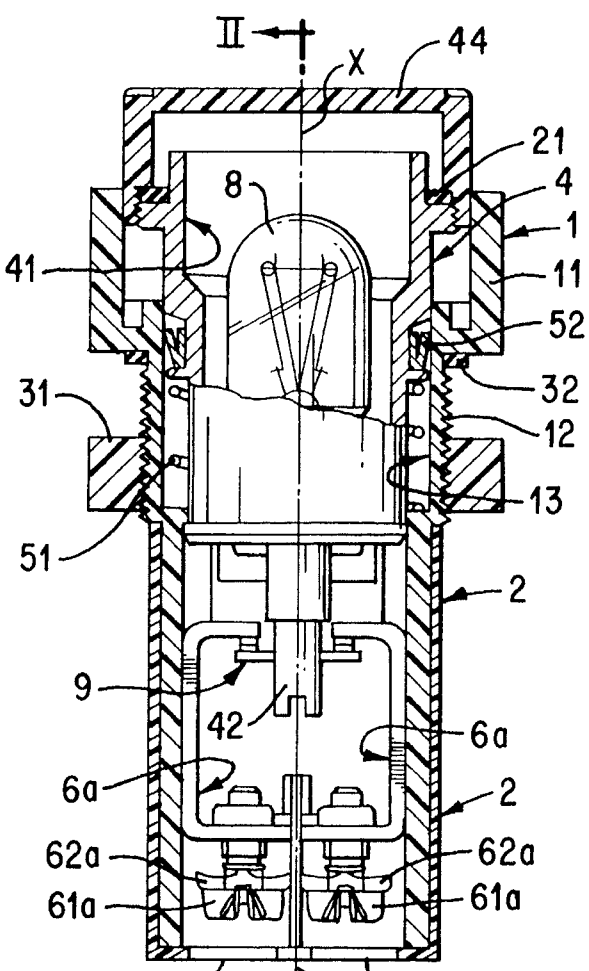
FIG. 1 is a view in axial section of a pushbutton switch with integral indicator lamp of the invention.
Figure 3:
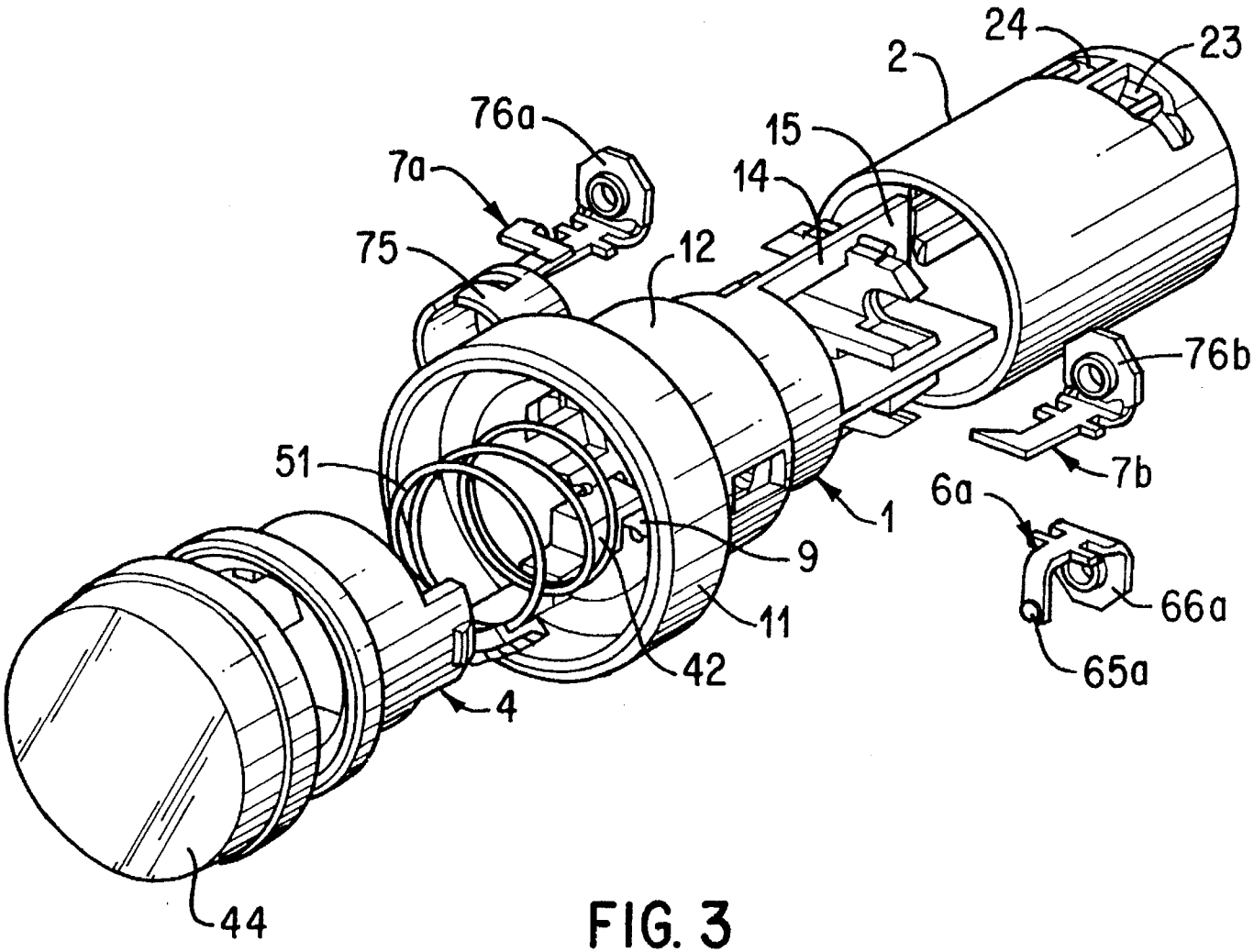
FIG. 3 is a perspective view of the pushbutton switch from FIGS. 1 and 2.

The control and/or indicator units shown in the drawings each include a one-piece plastics material body 1 with a central axis X–X'. The body 1 comprises at the front a cylindrical flange comprising, at the front, a larger diameter cylindrical portion 11 and, at the rear, a smaller diameter cylindrical portion 12, the two portions being joined by a shoulder. A cylindrical internal bore 13 concentric with the axis X–X' is formed in the body 1. The smaller diameter cylindrical part 12 has an external screwthread onto which screws a nut 31 for fixing the unit into a wall or panel opening. A seal 32 is sleeved over the cylindrical part 12 and lies against the shoulder formed by the flange.

The unit is mounted in a wall or a panel by inserting the cylindrical part 12 into a hole in the wall or the panel until the shoulder on the flange is pressed against the front of the wall. The nut 31 is then tightened against the rear of the wall to grip the latter and compress the seal 32.

The control and/or indicator unit includes conductive members 6*a*, 6*b*, 7*a*, 7*b* with screw terminals fixed to the body 1. Each conductive member has a connection area in which are formed an upstand and a screwthreaded opening for receiving a screw head, this screw passing through an associated clamping washer. The screws 61*a*, 61*b*, 71*a*, 71*b* have axes parallel to the axis X–X' and the screwheads face towards the rear of the unit. Each conductive member comprises a blade member bent to form the connecting area.

The cylindrical bore 13 is open and not partitioned on the side towards the conductive members 6*a*, 6*b*, 7*a*, 7*a* to provide room for a plunger or for conductive extensions for a lamp.

The body 1 has to the rear of the flange 11–12 a framework made up of two longitudinal tie rods 14 joined together by a crossmember 15 at the rear. This framework carries the conductive parts 6*a*, 6*b*, 7*a*, 7*b* appropriate to the various versions.

Figure 4:
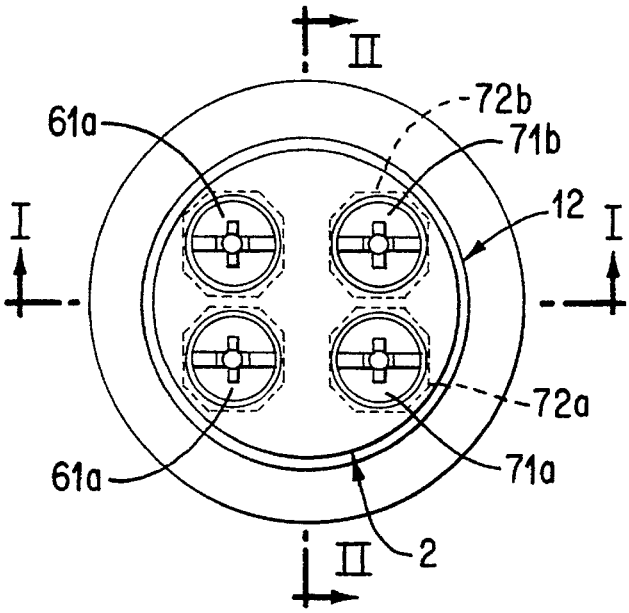
FIG. 4 is a rear view of the switch from FIGS. 1 and 2.

Each screw passes through a washer 62*a* or 62*b* or 72*a* or 72*b* which has a hole for the screw and a polygonal or circular external shape appropriate for mounting it in a protective cap 2 described in more detail below. The external shape of the washers is octagonal in FIGS. 4 and 5, for example.

The control unit providing the switch function comprises conductive members 6*a* and 6*b* which carry the screws and are provided with fixed contacts. Each conductive member 6*a* or 6*b* is U-shaped with one branch constituting a connection area 66*a* or 66*b* and the other branch carrying a fixed contact 65*a* or 65*b*. The screws 61*a* and 61*b* screw into the respective connection areas 66*a* and 66*b*. The fixed contacts cooperate with mobile contacts mounted on a mobile plunger 4 which operates the contacts. This plunger is accommodated in the bore 13 of the body 1 so that it is guided in translation along the axis X–X'. A spring 51 is housed in the annular space between the cylindrical part of the bottom of the plunger 4 and the bore 13. The spring 51 urges the plunger 4 forwards to a forward end of travel position defined by an abutment.

A seal 52 is housed in an annular groove formed at the periphery of the plunger 4. The seal 52 is in contact with the bore 13.

The plunger 4 carries one or two contact bridges 9 equipped with mobile contacts cooperating with fixed contacts of the conductive members 6*a*, 6*b* carrying the screws. Each mobile contact bridge 9 is mounted in a lateral extension forming a cage 42 and fastened to the plunger 4. A spring 92 is compressed between the cage 42 and the contact bridge 9 to provide the contact pressure and to enable movement of the plunger. The two conductive members 6*a*, 6*b* associated with the same bridge are mounted in a head-to-tail arrangement eccentrically to a plane passing through the X–X' axis.

The extension and the cage 42 of the plunger are eccentric to the X–X' axis. In the indicator lamp versions in particular, this arrangement frees up the central space occupied by the electrical power supply to the lamp cap.

In the unoperated position, the plunger 4 is pushed to its forward position by the spring 51. If the plunger 4 and the cap 44 are depressed, the contact bridge 9 is moved to the rear and the contacts open or close.

The unit providing the indicator function includes conductive members 7*a* and 7*b* which supply power to a luminous component 8 housed in the bore 41 of the plunger 4. In the embodiments shown this component is an incandescent lamp having a bayonet or Edison screw cap. As an alternative the luminous component can be a neon lamp or a light-emitting diode. The conductive member 7*a* is provided with a bush 75 for locking the lamp 8 and carries a screw 71*a* and an associated washer 72*b*. The electrical connection between the second screw terminal 71*b* and the contact stud projecting from the end of the lamp cap is provided by the conductive member 7*b* and a contact spring 73 concentric with the axis X–X' and bearing on this stud. The conductive member 7*b* is offset from the axis X–X' whereas the contact spring 73 is concentric with the axis X–X'. When a lamp 8 is fitted and locked into the bush 75 the contact spring 73 is compressed.

If the bush 75 is for a bayonet cap lamp it has grooves for the pegs projecting from the sides of the cap. If it is for an Edison screw cap lamp it has an inside thread into which the lamp cap is screwed.

The control and indicator unit shown in FIGS. 1 to 4 incorporates a pushbutton switch and an indicator lamp supplied with power via the screw terminals 71*a* and 71*b*. The plunger 4 is closed by a cap 44 at the front. This cap is made from a colored or clear transparent plastics material and is screwed to the plunger 4 whose bore 41 concentric with the axis X—X' opens into said cap. The cylindrical mobile plunger 4 has at least one lateral extension forming a cage 42 in which is mounted a contact bridge 9 cooperating with fixed contacts on the conductive members 6*a*, 6*b*.

The control unit shown in FIGS. 5 to 8 has two conductive members 6*a* provided with fixed contacts and two conductive members 6*b* each provided with a fixed contact. The plunger 4 has two lateral extensions forming two cages 42 in which are mounted two contact bridges 9. The plunger 4 has at the front a front bearing area 46 to act as a key. The two pairs of screw terminals 61*a* and 61*b* in this case supply current to the two contacts. Note that one of the contacts is a "normally closed" contact and that the other is a "normally open" contact.

Figure 5:
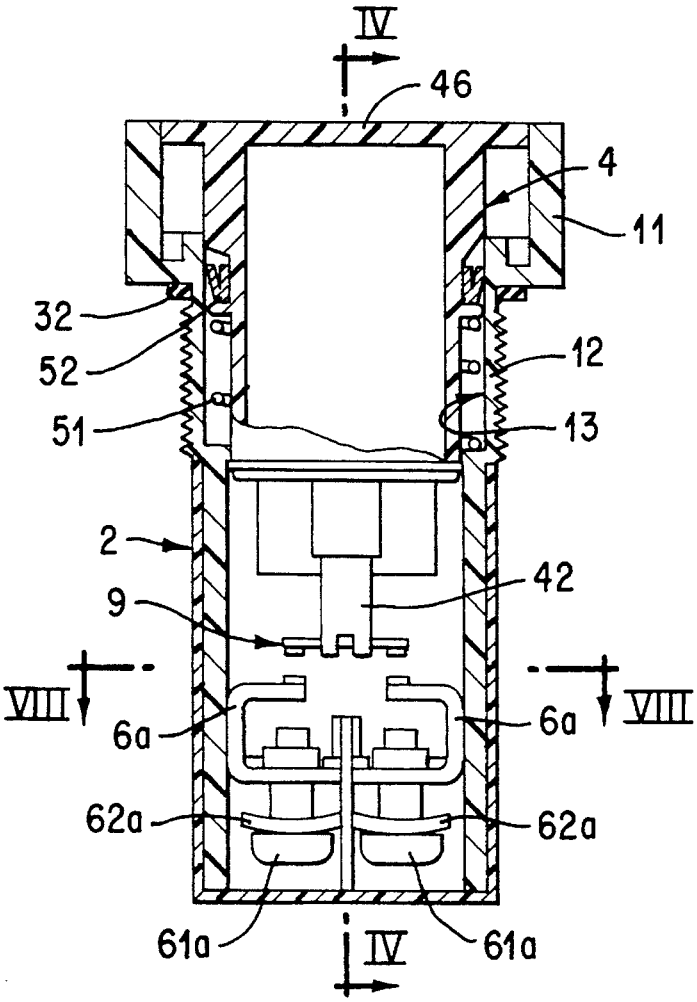
FIG. 5 is a view in axial section of a double contact pushbutton switch of the invention.
Figure 6:
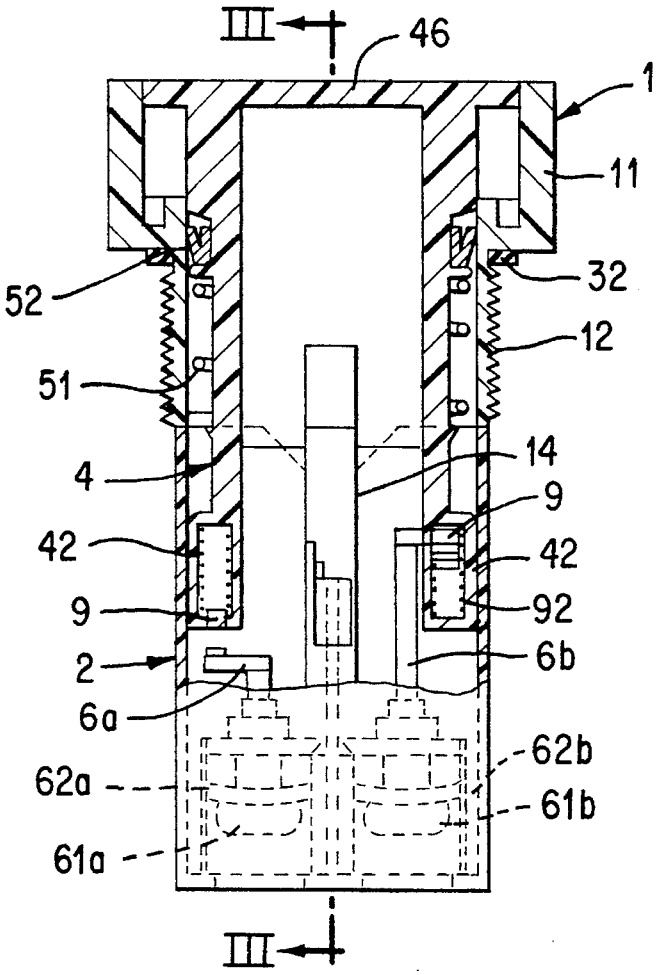
FIG. 6 is a view in axial section on the line IV—IV in FIG. 5.
Figure 7:
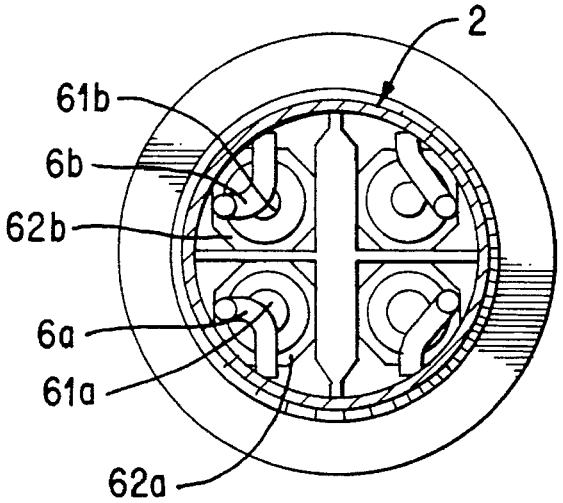
FIG. 7 is a view in section on the line VIII—VIII in FIGS. 5 and 6.
Figure 8:
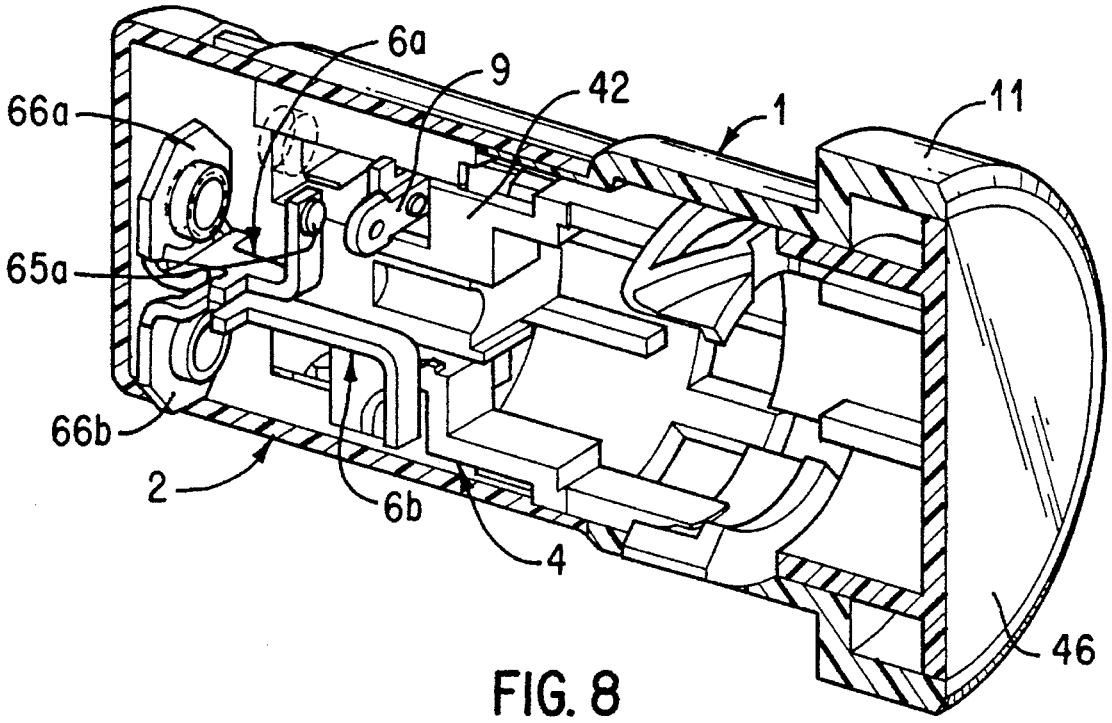
FIG. 8 is a perspective view of a variant of the push button switch from FIGS. 5 and 6.

While in the embodiment shown in FIGS. 5 and 6 the key 46 is in one piece with the plunger 4, in the embodiment shown in FIG. 8 the key 46 is separate from and attached to the plunger 4 so that the key color can be changed.

Figure 9:
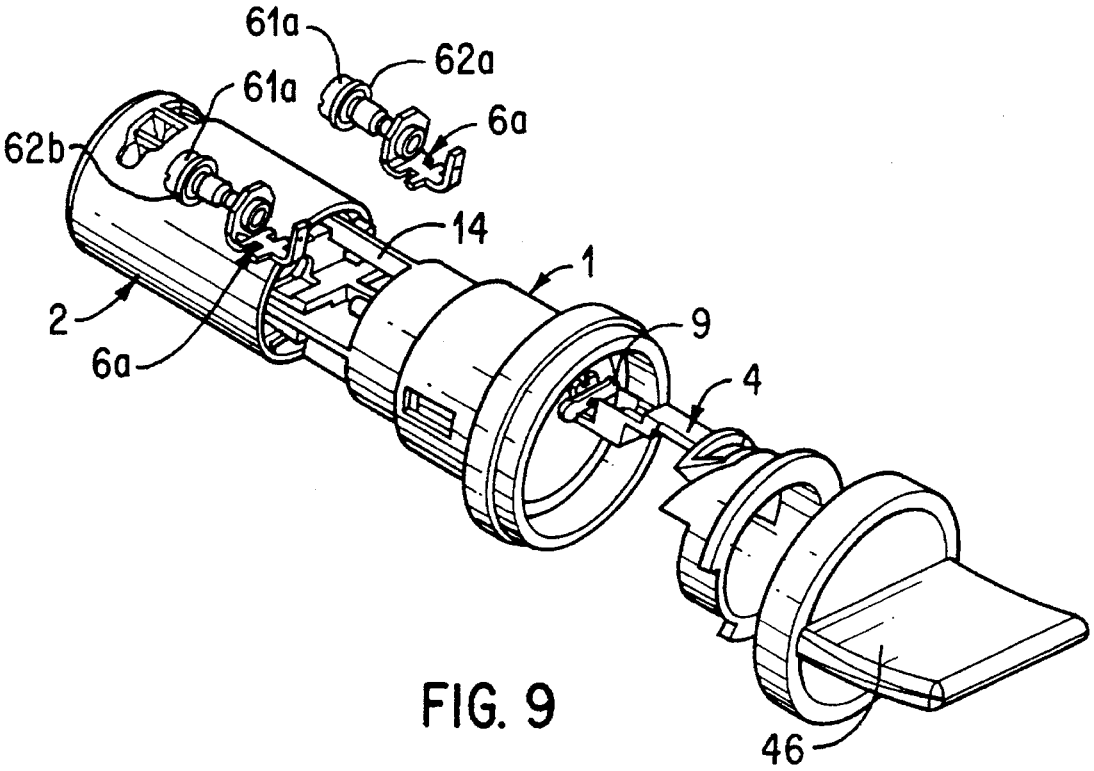
FIG. 9 is an exploded perspective view of a rotary knob control unit.

The control unit shown in FIG. 9 has a rotating knob 46 which moves the plunger 4 in translation.

Figure 11:
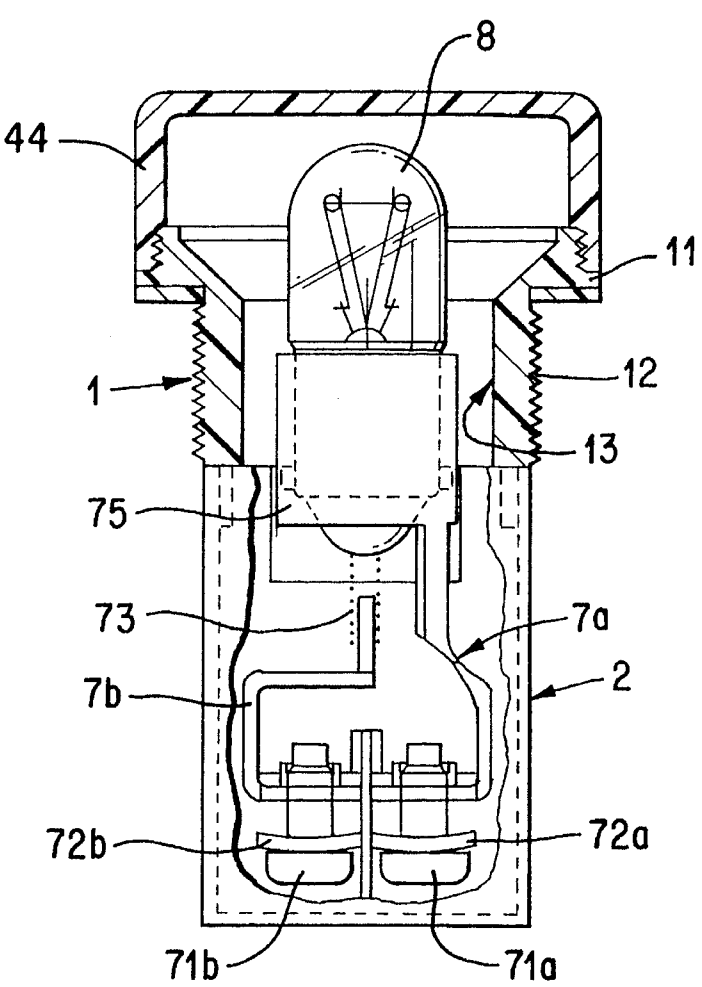
FIG. 11 is a view in axial section on the line VI—VI in FIG. 10.
Figure 10:
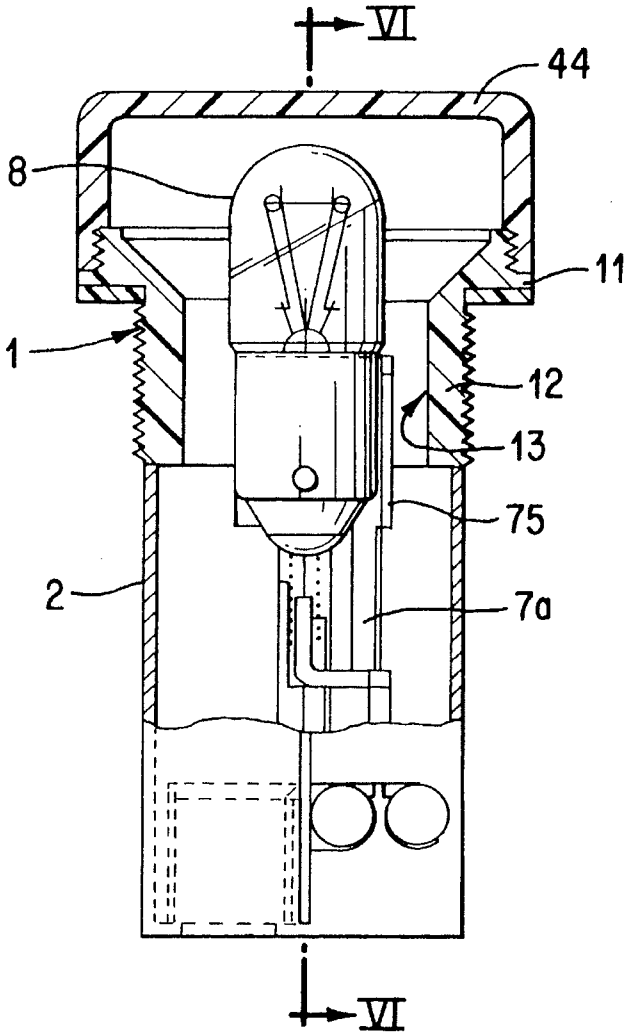
FIG. 10 is a view in axial section of an indicator lamp of the invention.
Figure 12:
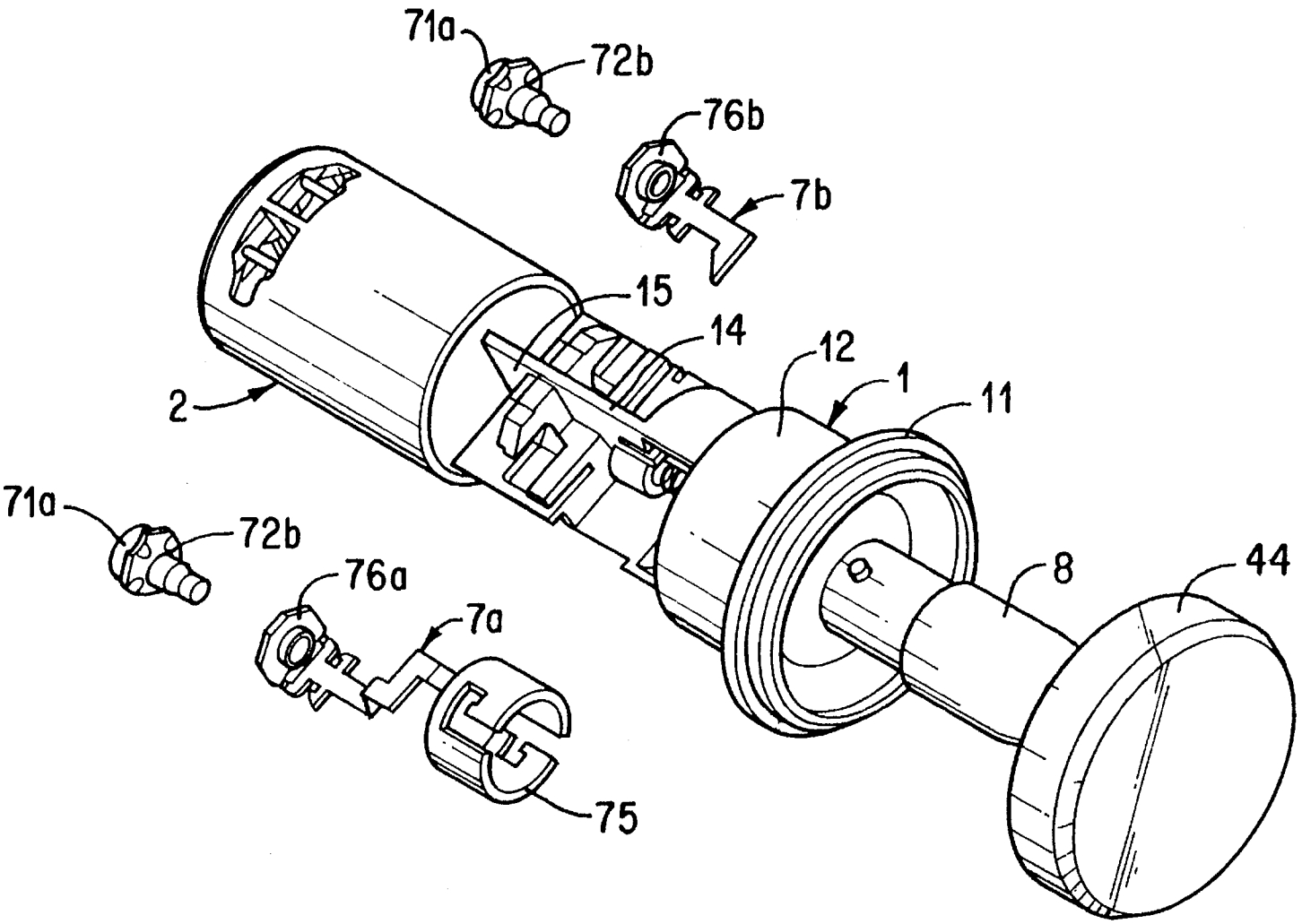
FIG. 12 is an exploded perspective view of the indicator lamp from FIGS. 10 and 11.

The indicator lamp shown in FIGS. 10 to 12 has a cap 44 which fixes to the body 1. The latter is extended downwardly by the framework 14 supporting the terminals, the bush 75 and the conductive members. The conductive members are supported by the framework of the one-piece body 1. The central contact of the lamp cap is in contact with the spring 73 mounted on the conductive member 7*b* on which are mounted the screw 71*b* and the associated washer 72*b*.

The rear framework of the body 1 is sleeved into a cap 2 which surrounds it. This plastics material cap 2 is generally cylindrical. Note that the outside diameter of the cap is less than the outside diameter of the screwthreaded part 12 to enable direct mounting of the unit on a panel or a wall.

The framework of the body 1 and the rear cap 2 are fastened together by any appropriate means.

The cylindrical wall of the cap 2 has openings 23 and 24 for conductors to be connected to the terminals. The back of the cover has openings 21 and 22 for inserting a screwdriver for operating the screws 61*a*, 61*b*, 71*a*, 71*b*.

It is to be understood that variants and improvements of detail and even the use of equivalent means are feasible without departing from the scope of the invention.

There is claimed:

1. A switch unit which provides at least one of a control signal and an indicator signal comprising:

(a) a body having:

(i) first and second ends;

(ii) a flange adjacent to said first end; and (iii) a body opening at said second end;

(b) a cap having:

(i) first and second ends;

(ii) a body receiving opening at said first end through which said second end of said body extends such that said cap at least partially closes said body opening;

(iii) a cap wall;

(iv) at least one wire access opening disposed in said cap wall; and (v) at least one screw access opening at said second end of said cap;

(c) at least one screw disposed inside of said cap, said at least one screw having a head inside of said cap, said head exposed to an exterior of said cap by way of said at least one screw access opening of said cap;

(d) at least one bent conductive member disposed inside of said cap, said at least one bent conductive member including a connecting portion which receives said at least one screw, and wherein said connecting portion is exposed to the exterior of said cap by way of said at least one wire access opening of said cap.

2. A switch unit as recited in claim 1, wherein said body further includes:

(a) an external screwthread; and (b) an internal cylindrical portion.

3. A switch unit as recited in claim 1, further including:

(a) a movable plunger which is movable between first and second positions;

(b) at least one lateral extension connected to said movable plunger, said lateral extension including a contact portion which contacts said at least one bent conductive member at least when said movable plunger is in said second position; and (c) wherein said body includes an internal guide portion which guides said movable plunger during movement between said first and second positions.

4. A switch unit as recited in claim 3, wherein said at least one bent conductive member includes four conductive members, and wherein said movable plunger includes two lateral extensions which form two contact bridges.

5. A switch unit as recited in claim 1, wherein said at least one bent conductive member includes two conductive members each having a fixed contact, the switch unit further including a luminous component and two luminous component conductive members for supplying power to said luminous component.

6. A switch unit as recited in claim 1, further including:

(a) a frame connected to said body and extending from said body opening, said frame having:

(i) two longitudinal tie rods;

(ii) a crossmember connected to a joining said two longitudinal tie rods; and (iii) at least one conductive member disposed on said frame.

7. A switch unit as recited in claim 1, further including:

(a) a movable plunger at least partially disposed in said body;

(b) a cage extending from said movable plunger forming a contact bridge;

(c) a luminous component mounted upon said movable plunger; and (d) two terminals connected to said luminous component.

8. A switch unit as recited in claim 1, further including:

(a) a luminous component;

(b) a luminous component conductive member which includes a bushing, wherein said luminous component is mounted in said bushing.

9. A switch unit as recited in claim 1, wherein said at least one bent conductive member is U-shaped.

10. A switch unit as recited in claim 1, further including a washer through which said at least one screw extends, said washer disposed inside of said cap.

11. A switch unit as recited in claim 1, further including a plunger having first and second ends, said plunger at least partially disposed in said body, said plunger including a key attached to said first end of said plunger, and wherein said first end of said plunger is closer to said first end of said body than said second end of said plunger.

12. A switch unit as recited in claim 1, further including at least one of a movable plunger and a luminous component.

* * * * *